US005765422A

United States Patent [19]

Donini et al.

[11] Patent Number: 5,765,422

[45] Date of Patent: Jun. 16, 1998

[54] DEVICE FOR THE CROSSED DISPLACEMENT OF ROLLING ROLLS

[75] Inventors: Estore Donini, Vimercate; Cesare Galletti, Segrate S. Felice; Fausto Drigani, Zugliano, all of Italy

[73] Assignee: Danieli & C. Officine Meccaniche SpA, Buttrio, Italy

[21] Appl. No.: 653,400

[22] Filed: May 24, 1996

[30] Foreign Application Priority Data

May 25, 1995 [IT] Italy ..... UD95A0094

[51] Int. Cl.[6] ..... B21B 31/00; B21B 31/07; B21B 13/14

[52] U.S. Cl. ..... 72/237; 72/241.2

[58] Field of Search ..... 72/237, 240, 245, 72/246, 247, 248, 241.2, 241.4, 244

[56] References Cited

U.S. PATENT DOCUMENTS

| | | | |
|---|---|---|---|
| 4,453,393 | 6/1984 | Hino et al. | 72/245 |
| 4,727,741 | 3/1988 | Ushifusa et al. | 72/237 |
| 5,291,770 | 3/1994 | Koujin et al. | 72/237 |
| 5,365,764 | 11/1994 | Kajiwara et al. | 72/237 |

FOREIGN PATENT DOCUMENTS

| | | | |
|---|---|---|---|
| 525552 | 2/1993 | European Pat. Off. . | |
| 0555882 | 8/1993 | European Pat. Off. . | |
| 12 48 599 | 8/1967 | Germany . | |
| 0106608 | 8/1980 | Japan | 72/237 |

OTHER PUBLICATIONS

Patent Abstracts of Japan vol. 9 No. 272 (M-425), 30 Oct. 1985 & JP-A-60 118311 (Mitsubishi), 25 Jun. 1985 Abstract & FIgures.

Patent Abstracts of Jap vol. 7 No. 47 (M-196) 24 Feb. 1983 & JP-A-57 195521 (Mitsubishi), 1 Dec. 1982 Figures & Abstract.

Patent Abstracts of Japan vol. 10 No. 66 (M-461) 15 Mar. 1986 & JP-A-60 210306 (Mitsubishi) 22 Oct. 1985 Abstract & Figures.

Patent Abstracts of Japan vol. 16 No. 458, (M-1315) 24 Sep. 1992 & JP-A-04 162904 (Mitsubishi) 8 Jun. 1992 Abstract; figures.

Patent Abstracts of Japan vol. 3 No. 3 (C-33) 16 Jan. 1979 & JP-A-53 127353 (Ishikawajima Harima) 7 Nov. 1978 abstract, figs.

Patent Abstracts of Japan vol. 4 No. 176 (M-45) 5 Dec. 1980 & JP-A-55 126305 (Mitsubishi) 30 Sep. 1980 Abstract, figures.

Soviet Patent Abstracts, Sec. ch, Week 9331 22 Sep. 1993, Derwent Publics. Ltd. GB & SU-A-1 754237 (Ferrous) 15 Aug. 1992 abstract.

Patent Abstracts of Japan vol. 18 No. 227 (M-1597) 25 Apr. 1994 & JP-A-60-023410 (Mitsubishi) 1 Feb. 1994 abstract, figures.

Patent Abstracts of Japn vol. 7 No. 47 (M-196) 24 Feb. 1983 & JP-A-57 195511 (Mitsubishi) 1 Dec. 1982 abstract figures.

Research Disclosure, No. 293, Sep. 1988 NY USA p. 658 XP 000096910 Disclosed Anonymously Rillign Mill Stand whole document.

*Primary Examiner*—Lowell A. Larson
*Assistant Examiner*—Rodney Butler
*Attorney, Agent, or Firm*—Antonelli, Terry, Stout & Kraus, LLP

[57] ABSTRACT

Device for the crossed displacement of rolling rolls, whether they be processing rolls (12) and/or back-up rolls (13), in a rolling mill stand (10) to produce plate and/or strip, the device including an upper rolling block (11*a*) and a lower rolling block (11*b*), the processing rolls (12) and back-up rolls (13) cooperating at the ends with respective supporting chocks (14), which in turn cooperate with respective stationary housing 15) in cooperation with at least one side of at least one chock (14) with at least one means of motion transmission (20) comprising guide and positioning cradle means (18), actuation means (24) and motor means (25) with the motor means (25) governed by a control unit (26).

7 Claims, 3 Drawing Sheets

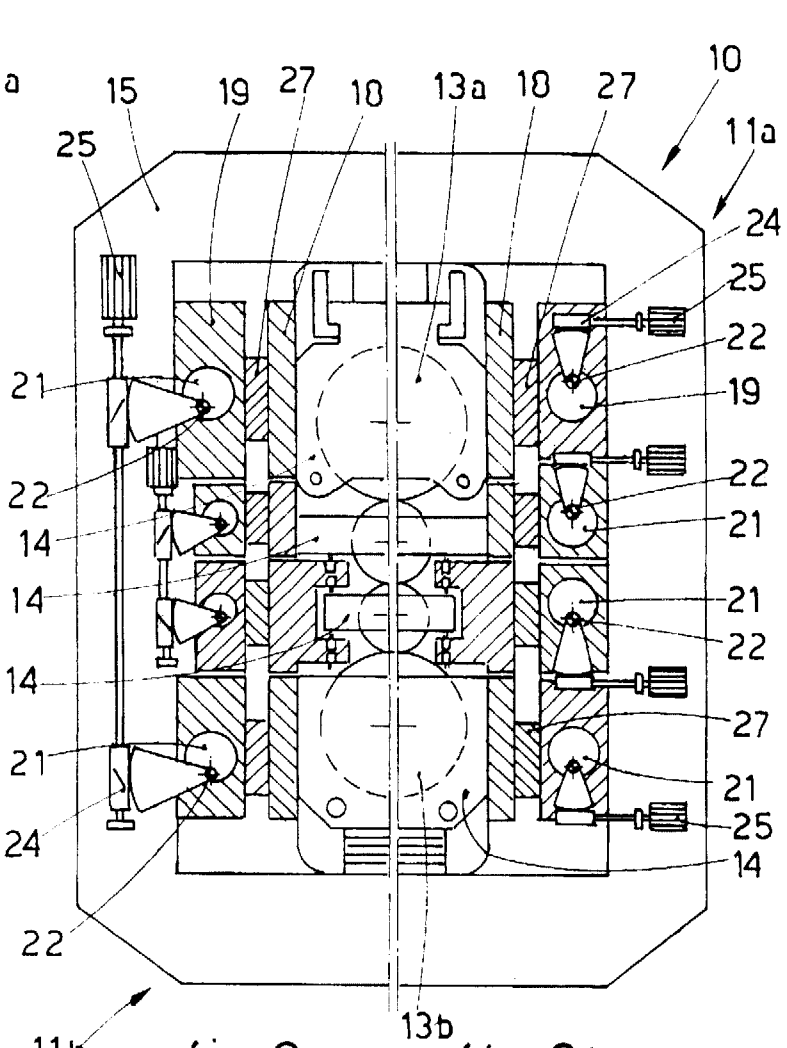
fig.3b
fig.3a
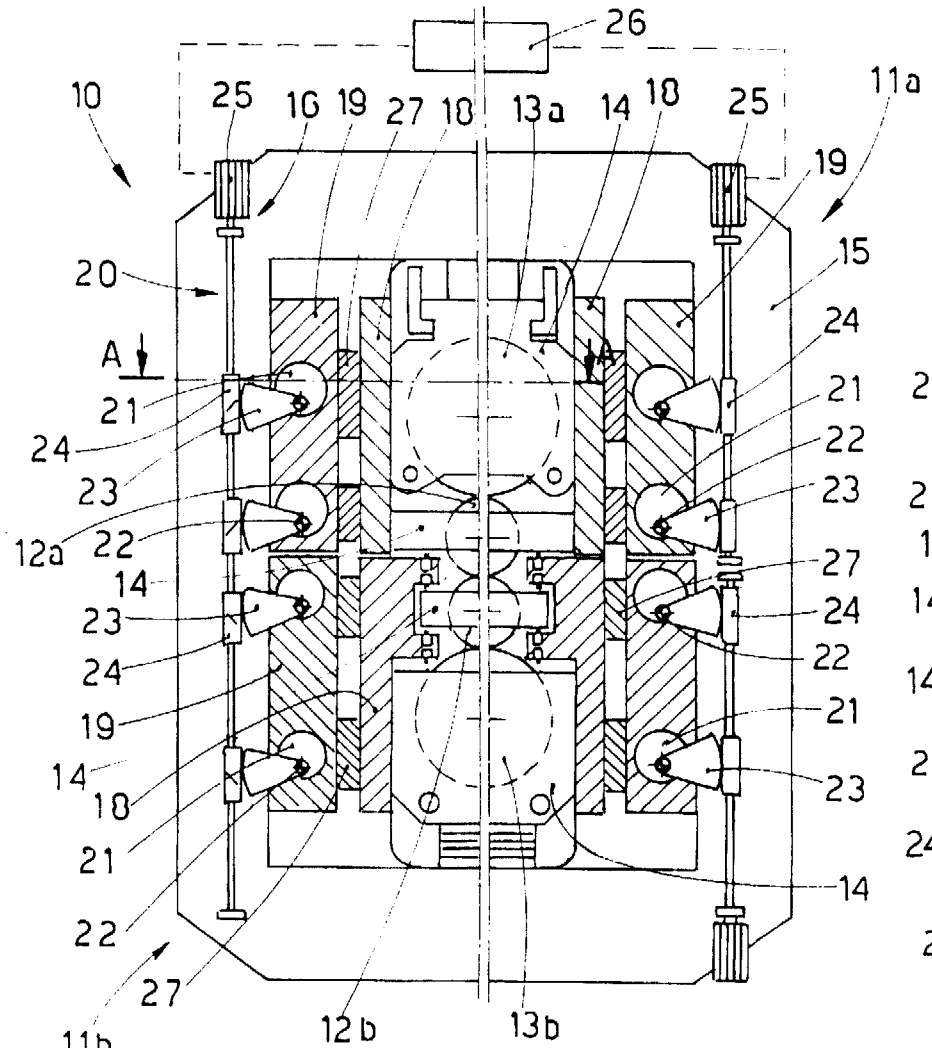
fig.1b
fig.1a

DEVICE FOR THE CROSSED DISPLACEMENT OF ROLLING ROLLS

BACKGROUND OF THE INVENTION

This invention concerns a device for the crossed displacement of rolling rolls whether they be processing rolls and/or back-up rolls.

To be more exact, the invention is employed in cooperation with the upper and lower rolling blocks of a four-high rolling mill stand to produce plate and/or strip for the purpose of making possible a crossed and coordinated displacement of the processing rolls and/or the back-up rolls.

The state of the art covers four-high rolling mill stands producing plate and/or strip which include opposed respective upper and lower processing rolls which define the rolling plane and are fitted to relative chocks located on one side and the other side of the rolling mill stand.

Each processing roll is associated with a relative back-up roll, which has the task of limiting the bends produced in the processing roll during rolling and enables very high rolling pressures to be used.

The state of the art covers the necessity to induce in the rolls a displacement in the rolling plane which causes a reciprocal crossed positioning of the rolls even though at very limited angles.

This displacement may be carried out during processing or in the initial pre-setting step.

This cross-over movement in the state of the art is generally carried out with the use of two different techniques.

SUMMARY OF THE INVENTION

According to a first technique traversing movements in suitable directions are imparted to all the chocks supporting the rolls.

So as to ensure the crossed positioning of the rolls, each chock positioned at one end of a roll, for instance a processing roll, receives a traversing movement in the opposite direction to the movement imparted to the opposite chock of the same processing roll and to the movement imparted to the chock at the same end of the opposed processing roll.

By using this technique, at least when the traversing of all the chocks has the same value, the vertical projection of the point of intersection of the axes of the rolls remains unchanged for any angle imparted to the axes of the rolls.

According to another displacement technique, the chock positioned at one side of the roll is traversed whereas the chock positioned at the opposite side is kept stationary, the movable chocks of the opposed rolls being positioned opposite each other.

In this case the position of the vertical projection of the point of crossover of the axes of the rolls is varied according to the direction of the traversing movement of the chocks and according to the value of that movement.

The state of the art discloses a plurality of systems for displacement of the chocks, for instance with gear systems, screw-threaded systems, jack systems and other systems.

All these systems, however, have been found unsatisfactory as regards accuracy of positioning, coordination of the movements, simplicity of embodiment and application, installation costs and also yet other reasons, amongst which are the great power required, the considerable bending caused thereby, the incorrect functioning of the bearings, etc.

The present applicants have therefore set themselves the aim of providing a simplified displacement system which makes possible the achievement of a desired, accurate and coordinated crossed displacement of the rolling rolls in a rolling mill stand for strip and/or plate, and for this idea of the main embodiment.

The purpose of this invention is to obtain a simplified device suitable to provide a crossed displacement of the rolling rolls which is accurate, controlled and coordinated.

According to the invention a positioning cradle is included between each chock supporting the rolls and the stationary housing and cooperates with a contrast block.

The reciprocal lateral positioning of the positioning cradle and of the contrast block is provided with adjustment and positioning means.

The variation of the reciprocal positioning, in one direction on one side of the chock, of the positioning cradle and the contrast block entails a coordinated reciprocal variation in the opposite direction on the other side of the same chock.

According to one embodiment of the invention each chock cooperates with a coordinated pair of adjustment and positioning means; a first adjustment and positioning means is located on one side of the chock, on the same front of the rolling mill stand, whereas the other adjustment and positioning means is located on the other side of the chock.

According to a first embodiment of the invention the adjustment of the reciprocal positioning of the positioning cradle and of the contrast block can affect each roll individually and only one chock of that roll.

According to another embodiment of the invention the adjustment may affect each roll individually and both chocks of the roll.

According to another variant the adjustment affects the processing roll and the back-up roll at the same time.

According to the invention the adjustment and positioning means are eccentric means and cooperate with actuation arm means governed by motor means.

In this case, according to the invention, hydraulic actuator capsules may be included between the positioning and guide cradle and the contrast block and have the purpose of preventing undesired deformations and of compensating any play.

According to a variant the adjustment and positioning means are conformed as a jack system.

BRIEF DESCRIPTION OF THE DRAWING

The attached figures are given as a non-restrictive example and show some preferred embodiments of the invention as follows:

FIGS. 1*a* and 1*b* are front views of two forms of embodiment of a rolling mill stand using a first embodiment of the invention;

FIGS. 3*a* and 3*b* are two forms of embodiment of a variant of FIGS. 1*a* and 1*b;*

DETAILED DESCRIPTION OF THE PREFERRED EMBODIMENTS

Figure 2:
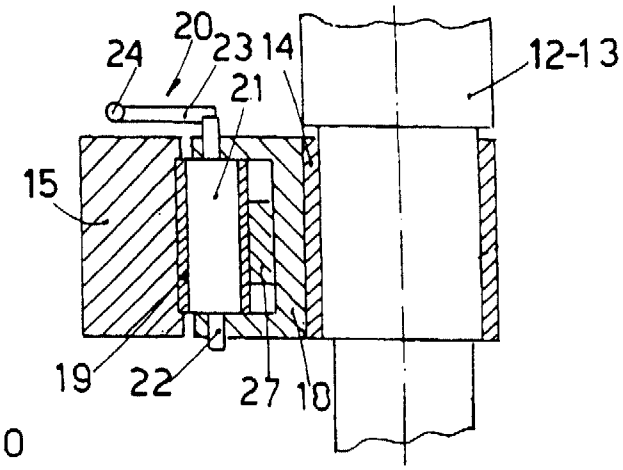
FIG. 2 shows a section along the line A—A of FIGS. 1*a* and 1*b;*

A rolling mill stand 10 for strip and/or plate, one front of which is shown schematically in the attached figures, includes an upper rolling block 11*a* and a lower rolling block 11*b* defining a rolling plane.

Each block, both the upper block 11*a* and the lower block 11*b*, normally comprises a respective processing roll 12 and respective back-up roll 13, respectively 12*a* and 13*a* for the upper block 11*a*, and 12*b* and 13*b* for the lower block 11*b*, fitted at their ends in their respective supporting chocks 14.

The rolling mill stand 10 comprises also an outer stationary supporting housing 15 per side.

According to the invention adjustment and positioning means 16 are included between one stationary housing 15 and the respective chocks 14 of the rolling mill stand 10 and are positioned in cooperation with both the sides of the chocks 14.

The function of these adjustment and positioning means 16 is to impart to the chocks 14 a lateral coordinated displacement movement so as to induce a reciprocal cross-over position at least in the rolls 12.

In this case the adjustment and positioning means 16 comprise at least one positioning and guide cradle 18 cooperating with a contrast block 19.

The motion transmission means 20 induce on the contrast block 19 a traversing movement which allows a movement of mating lateral displacement of the chocks 14.

In the case of FIGS. 1, 2, 4, 5*a*, 5*b*, 5*c*, and 6*a* the motor transmission means 20 comprise eccentric means 21 including the pivot 22 associated with actuation arm means 23.

The eccentric means 21 in the attached Figures are illustrated as a non-restrictive example with axis parallel to the nominal axis of the rolls 12–13.

The spirit of the invention foresees the use of eccentric means 21 also with vertical axis substantially broadside to the nominal horizontal axis of the rolls 12–13, although such solution is not illustrated but can immediately be appreciated.

The actuation arm means 23 can be of an angular sector (FIGS. 1 and 3), with a gear wheel (FIGS. 4 and 6*a*) or lever (FIG. 5).

The actuation arm means 23 cooperate with actuation means 24 governed by motor means 25.

The actuation means 24 can be with tangent screw (FIGS. 1 and 3), rack (FIGS. 4*b* and 6*a*), rod (FIG. 5), jack (FIG. 6*b*) in which case they also incorporate the motor means 25.

The motor means 25 are connected to each other through a control unit 26 (shown only in FIGS. 1*a* and 1*b*) so as to induce a coordinated movement whereby the positioning of the positioning and guide cradle 18 present on one side of the chock 14, corresponds to a mating positioning in the opposite direction of the other positioning and guide cradle 18 present on the other side of the chock 14.

In particular, the positioning and guide cradles 18 of the upper rolling block 11*a* receive, as regards the same front of the rolling mill stand 10, a movement in the opposite direction to that imparted to the positioning and guide cradles 18 of the lower rolling block 11*b*, so that the respective rolls have crossed axes of the desired value.

Between the positioning cradle 18 and the supporting housing 15 a hydraulic actuator capsule 27 may be positioned, with the function of distributing the thrusts and loads, thus preventing undesired deformations and compensating any play caused by the tolerances in the parts in reciprocal movement.

In the example of FIG. 1*a* the upper 11*a* and lower 11*b* rolling blocks are associated, per each front of the rolling mill stand 10, with one single motor means 25 connected to respective actuation means 24 which induce an opposite displacement in the elements of the upper block 11*a* to that in the elements of the lower block 11*b*.

In FIG. 1*b* each of the upper and lower rolling blocks 11*a*, 11*b* cooperates with a respective motor means 25.

According to the variant of FIG. 3*a* the contrast blocks 19 associated with the back up rolls 13*a*, 13*b* are associated with one and the same motor means 25 through respective actuation means 24 suitably fitted in the opposite direction to each other, whereas the processing rolls 12*a*, 12*b* are associated in turn with one and the same motor means 25, which too is connected to actuation means 24 fitted in the opposite direction to each other.

This embodiment makes it possible to manage in a differentiated manner, although coordinated through the control unit 26, the displacement of the processing rolls 12*a*, 12*b* as compared to the displacement of the back-up rolls 13*a*, 13*b*.

According to the further variant of FIG. 3*b*, each roll 12 and 13 may have its own motion transmission means comprising at least one motor means 25 with the relative actuation means 24.

According to a variant which is not shown here, the adjustment of the position is carried out only on one front of the chocks 14.

Figure 4A:
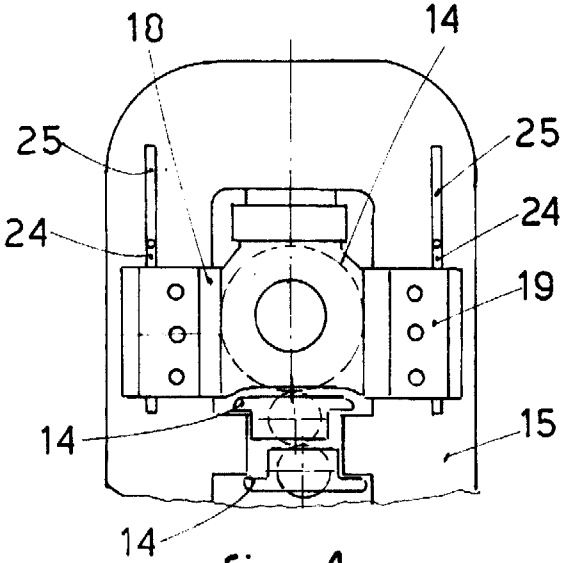
FIGS. 4*a* and 4*b* show two forms of embodiment of a second solution of the invention.
Figure 4B:
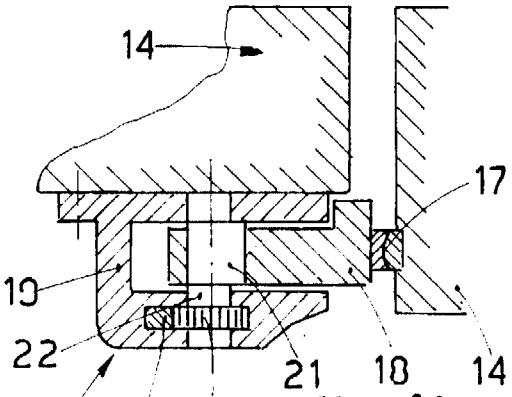

In FIGS. 4*a* and 4*b* there may be a revamping condition for an existing stand by applying on a wall the motion transmission means 20 which, with the positioning and guide cradle 18, act on the paired oscillating shoes 17 which, with their spherical cooperation surfaces, enable the chock 14 to be acted on.

Figure 5A:
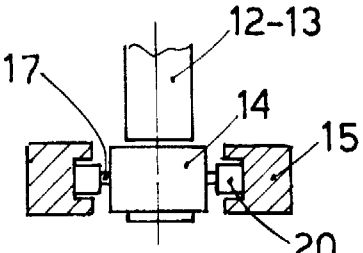
FIGS. 5*a*, 5*b* and 5*c* show a variant of the solution in FIG. 4.
Figure 5B:
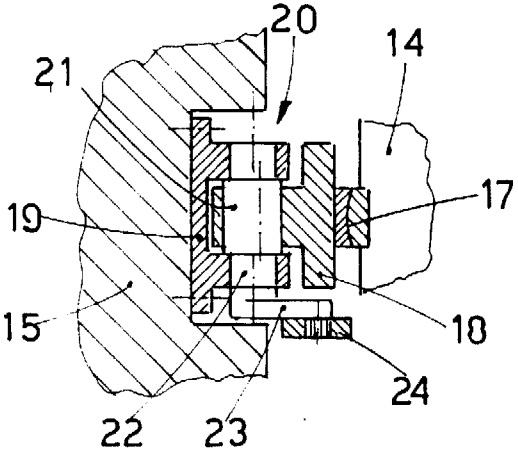
Figure 5C:
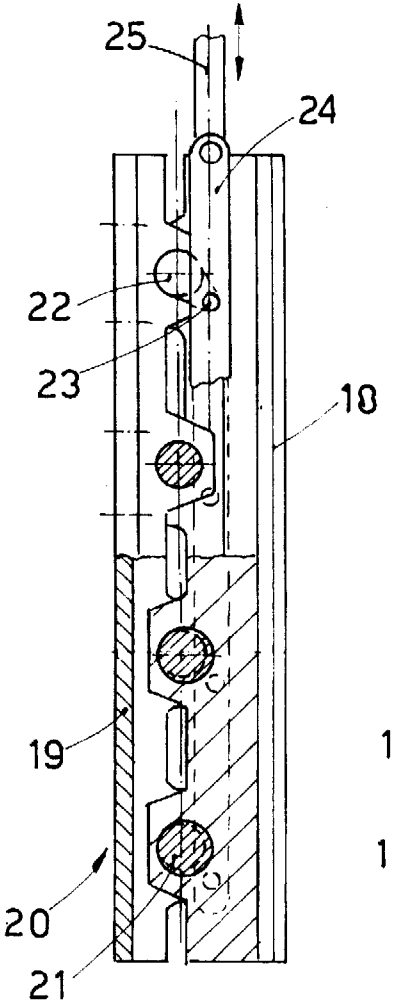

The solutions shown in FIGS. 5*a*, 5*b* and 5*c* illustrate a new stand with motion transmission means 20 fitted in a row (FIG. 5*c*) in median position.

Figure 6C:
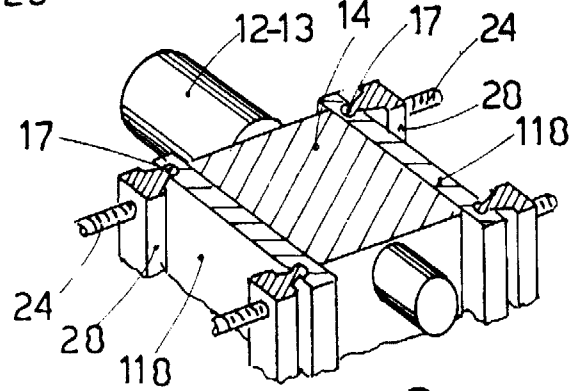
FIG. 6*c* is a partial three-dimensional view of the solution in FIG. 6*b*.
Figure 6B:
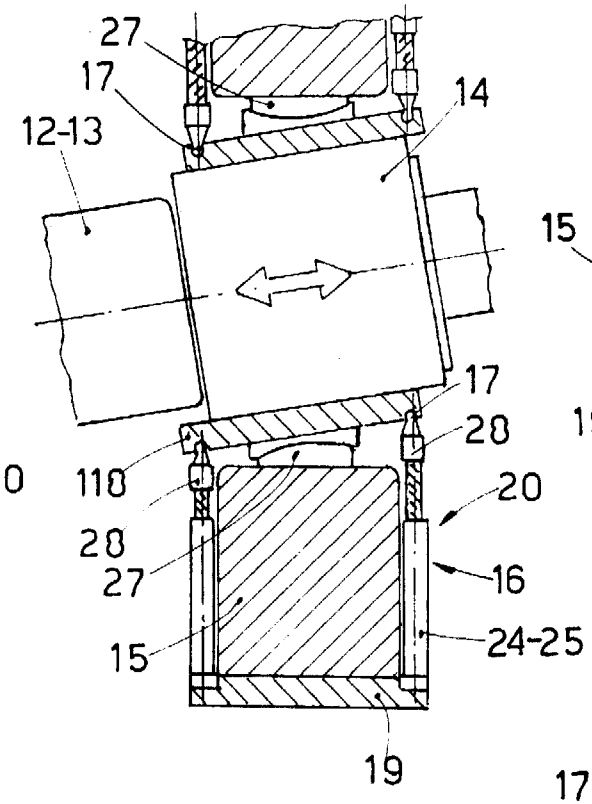
FIGS. 6*a* and 6*b* show another variant of the invention.
Figure 6A:
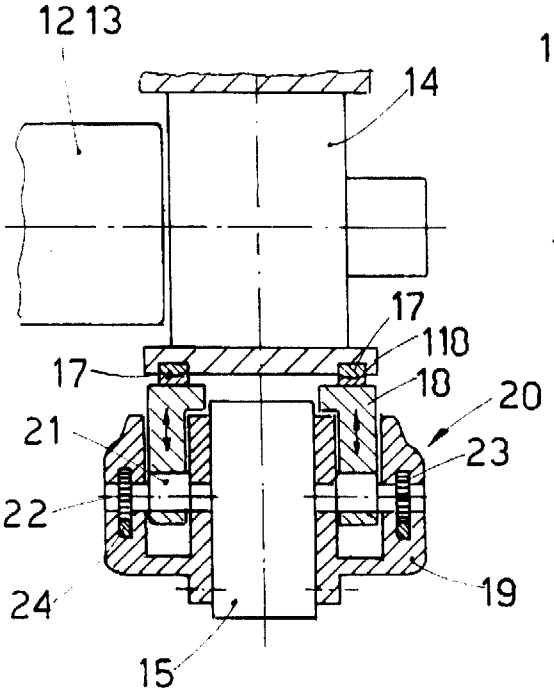

The solution in FIG. 6*a* illustrates a similar case to that of FIGS. 4*a* and 4*b* but with two motion transmission means 20 which work on a positioning and guide plate 118, which enables the said positioning and guide plate 118 to oscillate and also to create the desired guide for the axial shift of the system of chocks 14 and rolls 12.

FIGS. 6*b* and 6*c* illustrate a similar solution to that of 6*a* but with the use of commanded and controlled jacks 24–25 which work on a transmission bar 28 which cooperates with the positioning and guide plate 118 by means of oscillating shoes 17 of a cylindrical or spherical type cooperating with seating of a mating form.

In the spirit of the invention there may also be layers of anti friction material.

I claim:

1. Device for the crossed displacement of rolling rolls in a four-high rolling mill stand to produce plate and/or strip, the device comprising an upper rolling block and a lower rolling block, the upper and lower rolling blocks including processing rolls and back-up rolls cooperating at ends thereof with respective supporting chocks, the supporting chocks cooperating with a respective stationary housing, and, in cooperation with at least one side of at least one chock, at least one motion transmission mechanism for cross displacement of at least one of the processing and back-up rolls comprising a positioning and guide element operably connected to the at least one supporting chock, an actuator for actuating movement of the positioning and guide element, at least one motor for moving the actuator, the motor being governed by a control unit, and an eccentric mechanism for translating movement of the actuator to a lateral displacement of the positioning and guide element.

2. Device as in claim 1, in which the eccentric mechanism has an axis parallel to the rolls.

3. Device as in claim 1, in which the eccentric mechanism has an axis vertical to the longitudinal axis of the rolls.

4. Device as in claim 1, in which the motion transmission mechanism is placed on one side of the stationary housing.

5. Device as in claim 1, in which the motion transmission mechanism is placed on both sides of the supporting housing.

6. Device as in claim 1 in which the motion transmission mechanism is placed in cooperation with median vertical plane of the supporting housing.

7. Device for the crossed displacement of rolling rolls in a four-high rolling mill stand to produce plate and/or strip, the device comprising an upper rolling block and a lower rolling block, the Upper and lower rolling blocks including processing rolls an back-up rolls cooperating at ends thereof with respective supporting chocks, the supporting chocks cooperating with a respective stationary housing, and, in cooperation with at least one side of at least one chock, at least one motion transmission mechanism for cross displacement of at least one of the processing and back-up rolls comprising a positioning and guide element operably connected to the at least one supporting chock, a plurality of jacks operably connected to the stationary housing, and oscillating shoes connecting the jacks to the positioning and guide element, at least one jack being connected to each end of the positioning and guide element, whereby commanded and controlled movements of the plurality of jacks imparts a lateral displacement to the positioning and guide element by extending the at least one jack on one and of the positioning and guide element and retracting the at least one jack at another end of the positioning and guide element to impart a cross-over displacement to at least one of the process and back-up rolls.

* * * * *